United States Patent [19]

Hosoya

[11] 4,055,292

[45] Oct. 25, 1977

[54] CARTON WITH INTEGRAL SEPARABLE MEASURING VESSEL

[75] Inventor: Minoru Hosoya, Tokyo, Japan

[73] Assignee: Kao Soap Co., Ltd., Tokyo, Japan

[21] Appl. No.: 767,680

[22] Filed: Feb. 11, 1977

[51] Int. Cl.[2] ..... B65D 5/76

[52] U.S. Cl. ..... 229/17 M

[58] Field of Search ..... 229/17; 206/218, 217; 222/456, 81; 141/98, 392

[56] References Cited

U.S. PATENT DOCUMENTS 2,811,281 10/1957 Donovan ..... 229/17 M UX

*Primary Examiner*—Davis T. Moorhead

*Attorney, Agent, or Firm*—Blanchard, Flynn, Thiel, Boutell & Tanis

[57] ABSTRACT

A carton provided with an integral flap which can be separated and erected to form a measuring vessel.

12 Claims, 10 Drawing Figures

CARTON WITH INTEGRAL SEPARABLE MEASURING VESSEL

This invention relates to a carton provided with an integral, detachable portion which can be separated from the carton and then erected to form a measuring vessel. More particularly, this invention relates to a carton provided with an integral detachable flap which is cut and scored so that it can be folded and assembled to form a measuring vessel.

BRIEF DESCRIPTION OF THE DRAWINGS

A typical prior art carton is shown in FIG. 3. It is prepared by suitably bending a carton blank (a), shown in FIG. 1, along fold lines 18 (indicated by broken lines) and securing it in erected condition with an adhesive, such as paste. In FIG. 1, the solid lines that extend inwardly from the upper and lower edges of the carton blank, such as line 20, indicate cutting lines. Reference numerals 1 to 4 indicate the panels that form the sides of the carton, reference numerals 5 to 12 indicate end flaps adapted to be bent inwardly so that flaps 5 and 6 form the exposed top wall and bottom wall of the erected carton, respectively, and reference numerals 13 to 17 indicate marginal portions which are adapted to be overlapped with and secured by an adhesive to the panels 1, 2 and 4. Portion 13 is adapted to overlie and be adhered to a pouring opening portion defined by a perforated lower edge 19 so that by pulling away the portion 13 from its adhering relationship to panel 2, the lower edge 19 of the pouring opening portion can likewise be separated from the panel 2 and the contents of the container can be poured out through the opening that is thereby formed.

Figure 6:
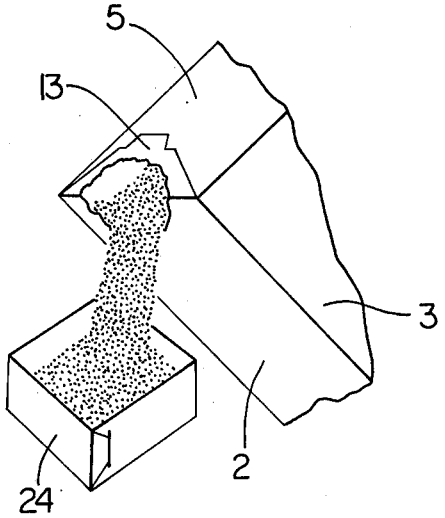
FIG. 6 is a perspective view illustrating the manner of using the measuring vessel.
Figure 7:
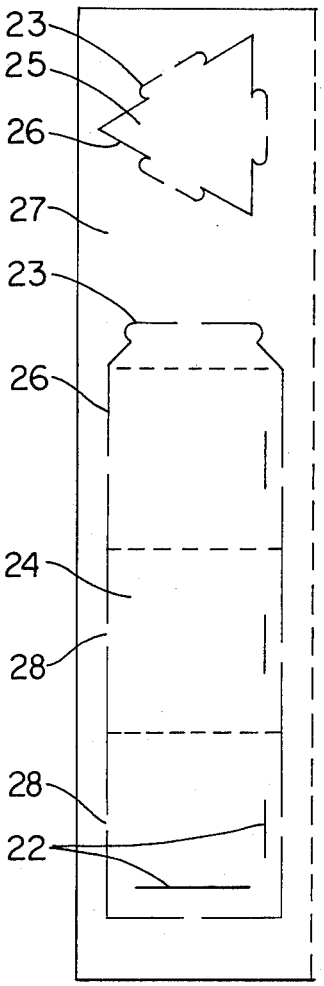
FIGS. 7 to 10 are plan views of modified flap portions which can be used to form modified measuring vessels.
Figure 8:
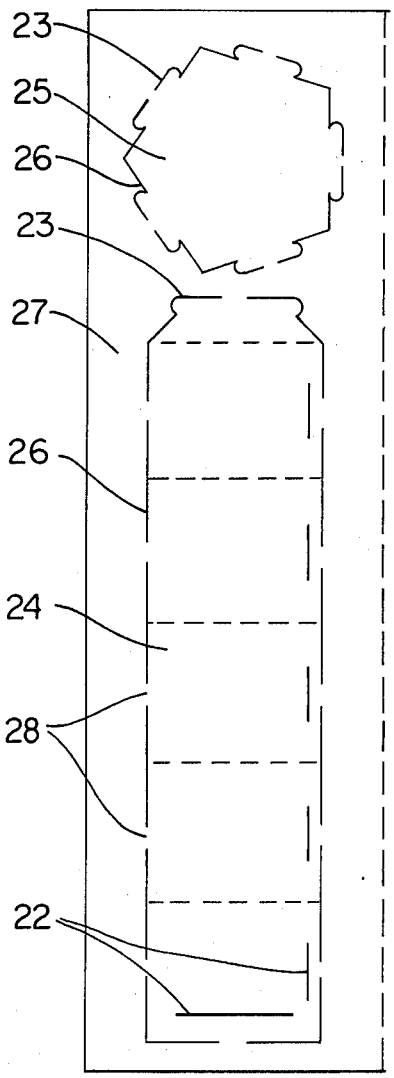
Figure 9:
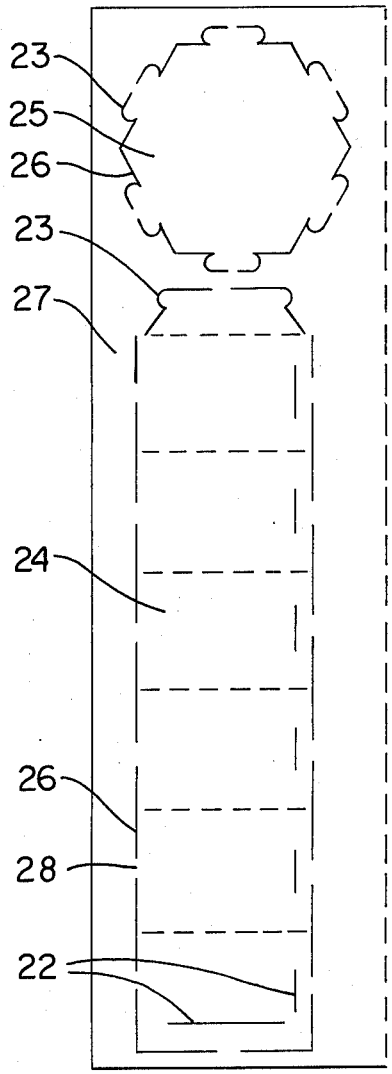
Figure 10:
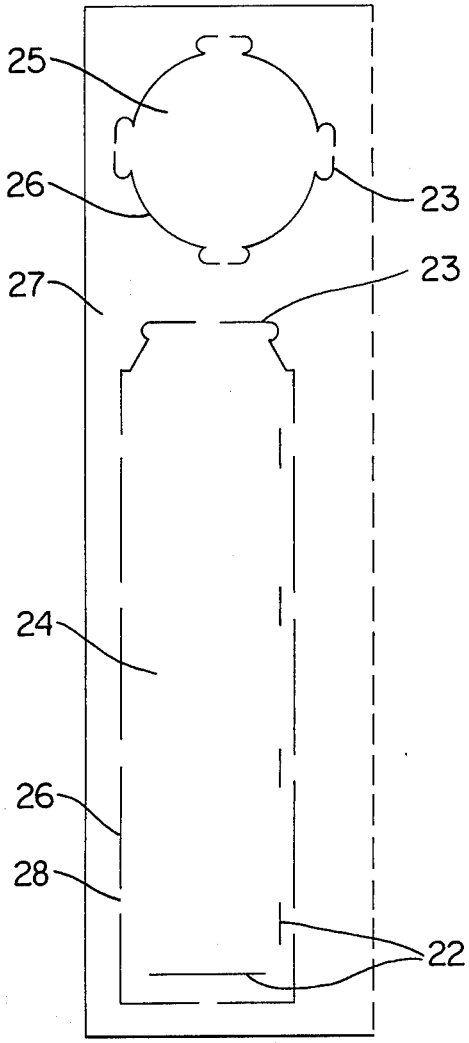

The carton may contain, for example, a granular detergent and the contents are poured out through the opening at the time of use as shown in FIG. 6. However, the amount of the contents of the carton that is poured out at any given time differs in many cases, according to the nature of the contents. It is customary for users to measure the amounts poured out with a separate measuring cup. This is awkward and inconvenient.

The present invention overcomes this disadvantage by providing a carton having an integral, but detachable, structure which can be erected to form a measuring vessel.

Figure 1:
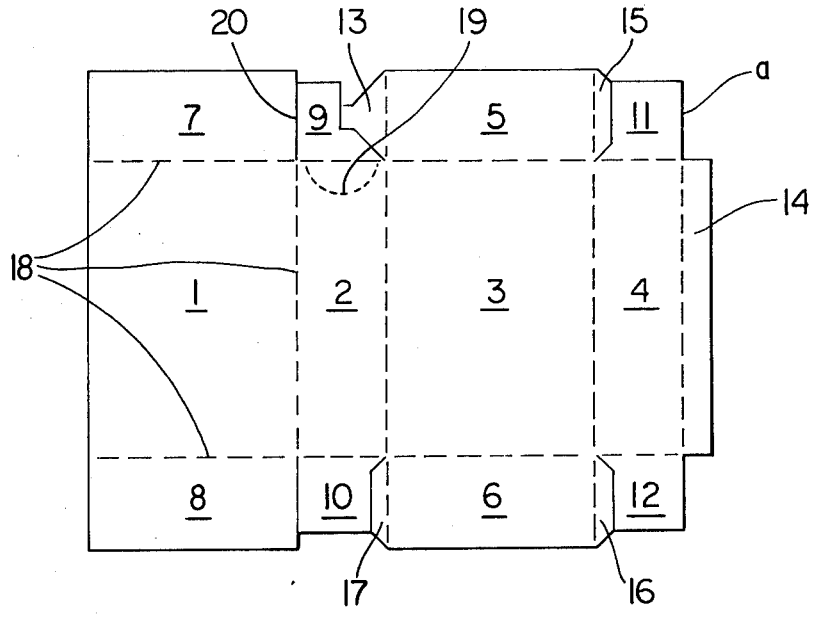
FIG. 1 PRIOR ART
FIG. 1 is a plan view of a carton blank for preparing a prior art carton.

An embodiment of the invention will be illustrated with reference to FIGS. 2 and 4 of the drawings:

To a conventional carbon blank, such as the one shown in FIG. 1, there is added a flap 27 which is connected with any of the panels that form the exposed sides, top or bottom of the erected carton and said flap 27 is adapted to be overlapped with and releasably adhered to the exterior surface of another panel. For example, in FIG. 2, flap 27 is connected to panel 1 by a score line and it is adapted to be folded into overlapping adhered relation to panel 4. The flap 27 has cut lines 26 (shown as substantially solid lines) so that the portion of said flap which defines the bottom 25 and sides 24 of the measuring vessel can be separated and assembled to form the measuring vessel. The cut lines 26 have discontinuities 28, i.e., they are more or less perforate lines, so that the measuring vessel section comprising members 25 and 24 cannot be unintentionally separated from the remainder of flap 27. The measuring vessel section is removed from the remainder of flap 27 by deliberately cutting or pulling along the cutting lines 26, when it is desired to erect the measuring vessel. If needed, the measuring vessel section of flap 27 can be spot glued to flap 4 to further guard against accidental separation, but such spot gluing will not hinder intentional separation of said measuring vessel portion. In FIG. 2, 21 indicates score lines for bending the members 24 and 25 erection of the measuring vessel and 22 indicates a slit adapted to have a projection 23 inserted therein for maintaining the measuring vessel in the erected condition.

Figure 2:
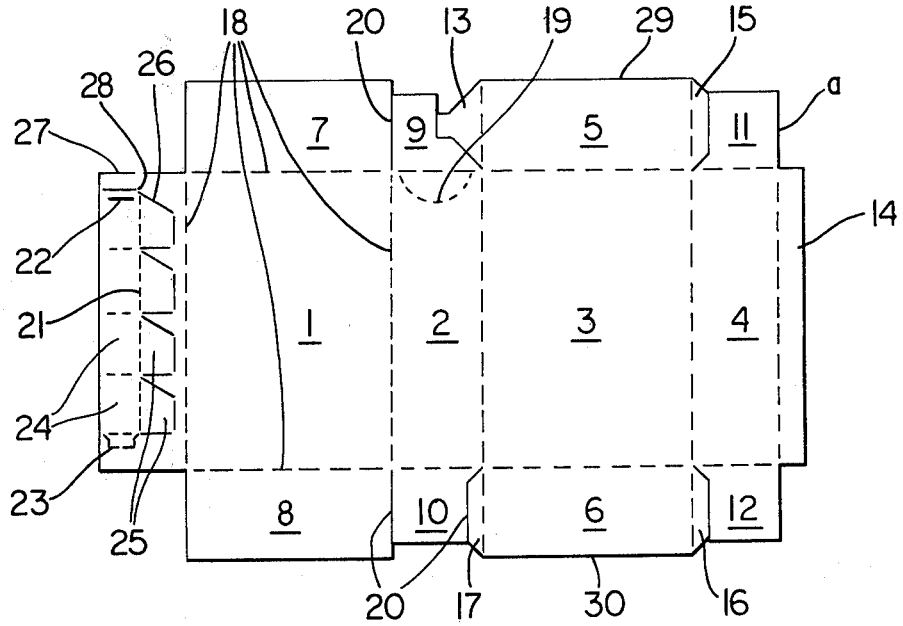
FIG. 2 is a plan view of a carton blank for preparing a carton according to the invention.
Figure 3:
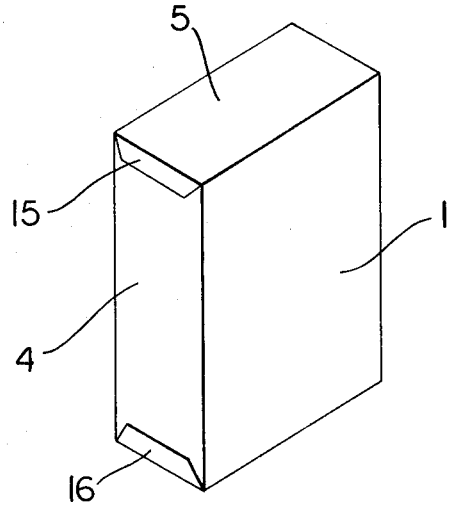
FIG. 3 PRIOR ART
FIG. 3 is a perspective view of a prior art carton made from the carton blank of FIG. 1.
Figure 4:
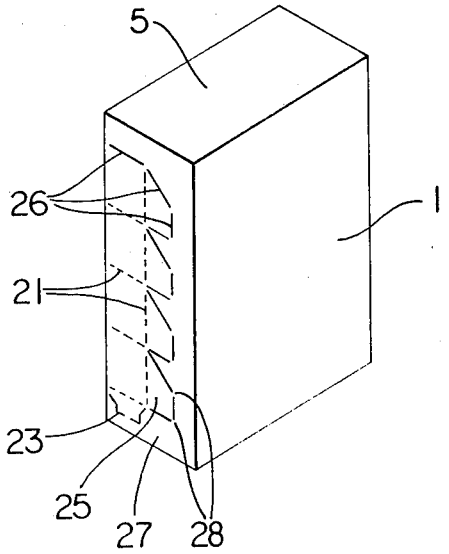
FIG. 4 is a perspective view of a carton according to the invention made from the carton blank of FIG. 2.

The carbon blank shown in FIG. 2 is bent suitably along the score lines 18 and is pasted to form a box as shown in FIG. 4. This box differs from the conventional box shown in FIG. 3 in that the flap 27 overlies the outer face of the side panel 4. The flap 27 is glued to the panel 4 at several points so that the former can be easily removed, when needed, and so that the flap 27 will not become loose during the handling thereof, for example, during transportation.

Figure 5:
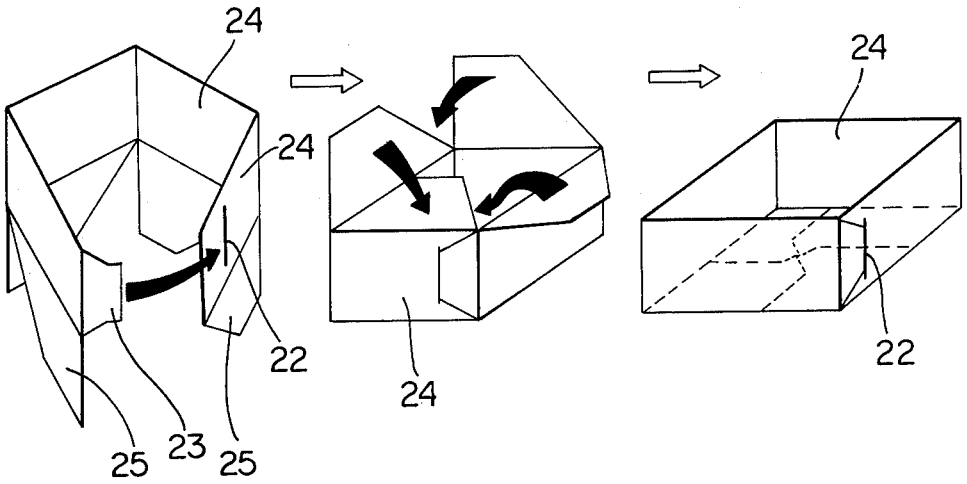
FIG. 5 is a schematic view showing the sequence of steps for forming a measuring vessel using a portion of the carton of FIGS. 2 and 4.

In setting up the measuring vessel, as shown in FIG. 5, bottom members 25 are combined with each other by mechanically interlocking them to each other or by gluing them whereby to form the bottom of the measuring vessel. The projection 23 is inserted in the slit 22 or the projection 23 is glued to the side face 24 to form the sides of the measuring vessel. The measuring vessel is thus obtained by the sequence of steps shown in FIG. 5.

In the utilization of the measuring vessel, a predetermined amount of the contents of the carton is poured into the measuring vessel as shown in FIG. 6 to measure the amount that is dispensed for use, such as in a washing machine.

With respect to the location of the flap 27 in the carton blank, it is preferred to connect it with the face 1 as shown in FIG. 2. But it can be connected with the face 4, in place of the margin 14, or it can be connected with the edge 29 of the face 5 or the edge 30 of the face 6. Further, concerning the shapes of the members 23, 24 and 25 defined by the score lines 21 and cutting lines 26, while those shown in FIG. 2 most suitable, the shape is not limited to that embodiment. For example, the cutting lines 26 can be provided so that the side wall member 24 and the bottom wall member 25 are formed separately as shown in FIGS. 7 to 10. Also the measuring vessel can have various polygonal shapes or a circular shape, as shown in FIGS. 7 to 10. The measuring vessels can be erected from the flaps shown in FIGS. 7 to 10 in substantially the same manner as the one shown in FIG. 2.

The carton according to the present device is very convenient in practical use because the measuring vessel can be manufactured and transported in combination with the carton, it can be separated from the carton and set up easily, and the amount of the contents dispensed from the carton can be measured.

The embodiments of the invention in which an exclusive property or privilege is claimed are defined as follows:

1. In a carton having side panels and end walls defining a closed chamber, the improvement which comprises: said carton has an external flap overlapping one of said side panels and end walls and integral with said carton, said flap having lines of separation providing the side wall and bottom wall of a measuring vessel which can be separated from the carton and then erected to form the measuring vessel.

2. A carton as claimed in claim 1 in which said carton is made of sheet-form material with said chamber being of substantially rectangular cross-sectional shape and with the ends of said chamber being closed by said end walls.

3. A carton as claimed in claim 2 in which said flap is foldably connected to an edge of one of said side panels and is releasably secured in external face-to-face overlapping relation to the adjacent side panel.

4. A carton as claimed in claim 2 in which said flap is foldably connected to an edge of one of said end panels and is releasably secured in external face-to-face overlapping relation to an adjacent side panel.

5. A carton as claimed in claim 2 in which said flap has lines of separation and lines of folding that define a onepiece section which can be folded to define a closed side wall and a transversely extending closed bottom wall.

6. A carton as claimed in claim 2 in which said flap has lines of separation and lines of folding that define a first separation which can be folded to define a closed side wall and a separate second section which defines a closed bottom wall wherein said bottom wall is adapted to extend transversely to said side wall and to close off one end thereof, said first and second sections having mutually engageable means for retaining said bottom wall within said side wall.

7. In a carton blank having foldably connected portions defining side panels and end walls which are adapted to be folded and secured together to form a closed chamber, the improvement which comprises: said carton blank has an integral projecting flap foldably connected to one of said portions for being folded into overlapping relationship to one of said side panels and end walls, said flap having lines of separation providing the side wall and the bottom wall of a measuring vessel which is separable from said carton blank, and which can be erected to define a measuring vessel.

8. A carton blank as claimed in claim 7 in which said carton blank is made of sheet-form material and said foldably connected portions are shaped so that the chamber defined thereby is of substantially rectangular cross-sectional shape and with the ends of said chamber being closed by said end walls.

9. A carton blank as claimed in claim 8 in which said flap is foldably connected to an edge of the portion defining one of said side panels.

10. A carton as claimed in claim 8 in which said flap is foldably connected to an edge of the portion defining one of said end panels.

11. A carton as claimed in claim 8 in which said flap has lines of separation and lines of folding that define a onepiece section which can be folded to define a measuring vessel having a closed side wall and a transversely extending closed bottom wall.

12. A carton as claimed in claim 8 in which said flap has lines of separation and lines of folding that define a first section which can be folded to define a closed side wall of the measuring vessel and a separate second section which defines a closed bottom wall of the measuring vessel, said bottom wall being adapted to extend transversely to said side wall and to close off one end thereof, said first and second sections having mutually engageable means for retaining said bottom wall within said side wall.

* * * * *

UNITED STATES PATENT AND TRADEMARK OFFICE

CERTIFICATE OF CORRECTION

PATENT NO. : 4 055 292

DATED : October 25, 1977

INVENTOR(S) : Minoru Hosoya

It is certified that error appears in the above-identified patent and that said Letters Patent are hereby corrected as shown below:

Claim 6, Column 3, line 37; change "separation" to ---section---.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*